US005285727A

United States Patent [19]

Reams, Jr. et al.

[11] Patent Number: 5,285,727

[45] Date of Patent: Feb. 15, 1994

[54] SEMICONDUCTOR IGNITOR

[75] Inventors: Robert B. Reams, Jr.; Jonathan Terrell, both of Silver Spring; Bohdan Dobriansky, Bethesda, all of Md.; Judith T. McCullen, Buffalo Mills, Pa.; Raymond Goetz, Baltimore County, Md.

[73] Assignee: The United States of America as represented by the Secretary of the Army, Washington, D.C.

[21] Appl. No.: 866,776

[22] Filed: Apr. 2, 1992

[51] Int. Cl.[5] ..... F42B 3/13

[52] U.S. Cl. ..... 102/202.5; 102/472

[58] Field of Search ..... 102/202.2, 202.5, 202.7, 102/202.9, 202.14, 472

[56] References Cited

U.S. PATENT DOCUMENTS

| | | | |
|---|---|---|---|
| 4,484,523 | 11/1984 | Smith et al. | 102/202.5 |
| 4,729,315 | 3/1988 | Proffit et al. | 102/202.9 |
| 4,819,560 | 4/1989 | Patz et al. | 102/202.5 |
| 4,869,170 | 9/1989 | Dahmberg et al. | 102/202.5 |
| 4,893,563 | 1/1990 | Baginski | 102/202.5 |
| 4,967,665 | 11/1990 | Baginski | 102/202.2 |
| 5,085,146 | 2/1992 | Baginski | 102/202.5 |
| 5,113,764 | 5/1992 | Mandigo et al. | 102/202.9 |

*Primary Examiner*—Harold J. Tudor

*Attorney, Agent, or Firm*—Saul Elbaum; Jason M. Shapiro; Frank J. Dynda

[57] ABSTRACT

An RF-insensitive semiconductor ignitor and primer cup assembly is created using a double polished n-type silicon substrate having its top and bottom surfaces partially metallized to form Schottky barrier diodes. The metallized portion of the back side of the substrate is placed in contact with a conductive surface, and means are provided to electrically isolate those portions of the substrate which have not been metallized from both the metallized portions and the conductive surface. In one embodiment, the isolating means is an integral oxide ring which extends from the periphery of the contact metal to the edge of the substrate. In another embodiment, the means of isolation is a separate plastic ring.

12 Claims, 2 Drawing Sheets

SEMICONDUCTOR IGNITOR

GOVERNMENTAL INTEREST

The invention described herein may be manufactured, used and licensed by or for the U.S. Government for governmental purposes without the payment to us of any royalties thereon.

BACKGROUND OF THE INVENTION

The present invention relates to electrical primers and ignitors, and more particularly to an RF-insensitive semiconductor ignitor for use in firing ammunition rapidly and reliably.

Conventional small caliber shells employ mechanical or electrically initiated charge ignitors to create an ignition train which sets off the main propellant. Mechanical propelling charge ignitors are usually provided with percussion caps which are made to fire upon exposure to a mechanical impulse such as that caused by a firing pin or hammer blow. Electrically initiated charge ignitors, on the other hand, fire under the influence of a current pulse which may melt a resistive bridge wire, vaporize a metallic layer at an arc point, or pass through an electrically conductive charge.

A problem peculiar to conventional electrical ignitors is their sensitivity to electromagnetic (EM) radiation. EM fields may couple with an electrical propelling charge ignitor causing premature initiation. This problem is particularly acute aboard naval vessels which typically support multiple high power electromagnetic sources in close proximity to ordnance.

Various solutions to the problem of EM susceptibility, and the sensitivity of electroexplosive devices to RF fields in particular, are discussed in U.S. Pat. No. 5,085,146 to Baginski, which is hereby incorporated by reference. Baginski proposes a semiconductor device in which two p-n junctions have been created on top and bottom surfaces of a silicon substrate. Conductive layers atop the p-n junctions channel the firing current through the junctions, causing a small plug of conductive material on the top surface to vaporize. This generates a burst of hot plasma which ignites the primer mix and fires the propelling charge.

Applicants fabricated and tested a semiconductor ignitor which employs back-to-back Schottky diodes for use with the PHALANX CWIS 20-mm cartridge. As a consequence of these studies it was discovered that the back diode exhibits a tendency to short out when integrated into the PHALANX primer cup assembly. It was subsequently determined that similar failures could be produced by placing the semiconductor ignitor on a conductive sheet and exposing it to high pressures.

SUMMARY OF THE INVENTION

Accordingly, it is an object of the present invention to provide an RF insensitive semiconductor ignitor which fires reliably when integrated into a round of ammunition.

It is another object of the present invention to provide a semiconductor ignitor which employs back-to-back Schottky diodes in such a manner as to prevent the occurrence of an ohmic contact in parallel with the back diode.

It is yet another object of the present invention to provide a reliable primer cup assembly employing a semiconductor ignitor.

These objects and others not specifically enumerated are accomplished with a double polished n-type silicon substrate having its top and bottom surfaces partially metallized to form Schottky barrier diodes. The metallized portion of the back side of the substrate is placed in contact with a conductive surface, and means are provided to electrically isolate those portions of the substrate which have not been metallized from both the metallized portions and the conductive surface.

In one embodiment, the electrical isolation means is an integral oxide ring which extends from the periphery of the contact metal to the edge of the substrate. In another embodiment, the isolating ring is a separate plastic ring.

BRIEF DESCRIPTION OF THE DRAWINGS

The preferred embodiments of the present invention will be described with reference to the accompanying drawings in which.

DESCRIPTION OF THE PREFERRED EMBODIMENTS

The present invention was originally developed for use as an electrically-fired propellant charge ignitor in 20 mm ammunition, such as the PHALANX CWIS 20 mm cartridge 11 illustrated in FIG. For this type of application, the ignitor is usually in the form of a primer cup 13 which fits into the base of the cartridge case behind the propellant charge. A current pulse is applied across the primer cup assembly 13 and the shell 11 to fire the round. Unfortunately, when conventional electronic ignitors are exposed to high intensity EM radiation, such as that experienced aboard a naval vessel, there is the possibility of spontaneous accidental firing.

Figure 1:
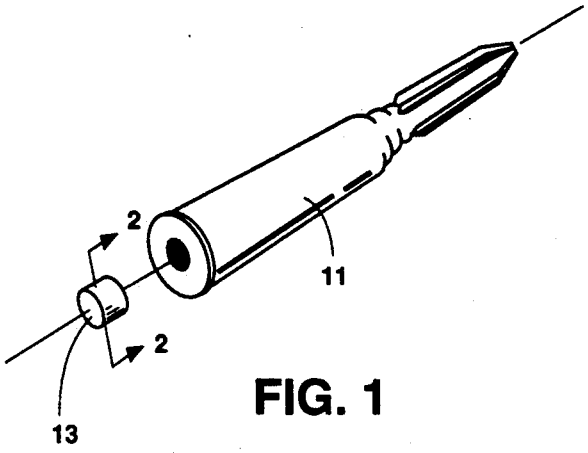
FIG. 1 is an illustration of a 20 mm shell With its primer cup dislodged.
Figure 2:
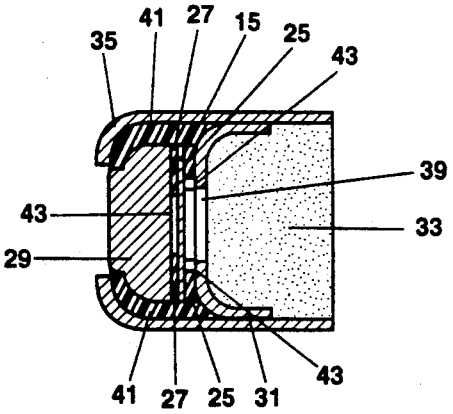
FIG. 2 is a cross-sectional view of a primer cup assembly utilizing the semiconductor ignitor.

A primer cup assembly 13 according to the present invention is shown in FIG. 2. Desensitization is accomplished through the use of a semiconductor ignitor 15, the details of which are explained later with reference to FIGS. 3 and 4. The semiconductor ignitor 15 is disposed within an electrically conductive housing 35 between a conductive surface, or button 29, and an inner support cup 30 which holds an electrically conductive primer mix 33. A hole 39 in the base of the inner support cup 31 allows the primer mix 33 to contact the top side of the semiconductor ignitor 15. The housing 35, button 29, and inner support cup 31 are typically made of brass, or some other conducting metal.

The button 29 is electrically isolated 41 from the conductive housing 35 to prevent a short which would bypass the semiconductor ignitor 15. Thus, it is possible to apply electrical energy to the semiconductor ignitor 15 by creating a sudden voltage potential across the button 29 and housing 35. Electrically conductive epoxy 43 ensures continuity and fixes the ignitor 15 within the assembly. Prior art semiconductor ignitors failed to fire reliably when integrated in such a manner.

Failure analyses of the prior art semiconductor ignitors revealed plastic deformation of their inner support cups 31, split housings 35, and cracks in the semiconductor ignitors themselves. It is believed that the semiconductor ignitors suffered "coining", or centrally supported uniform plate loading, resulting in edge contact with the conductive button 29. Edge contact with the conductive button 29 is particularly troublesome as it would provide an ohmic contact in parallel with the desired Schottky junction, thereby shorting the system.

The present invention overcomes these problems by providing an insulating ring 27 between the bottom of the semiconductor ignitor 15 and the conductive button 29. The insulating ring 27, which may be an oxide layer grown on the surface of the silicon wafer or a separate mask of insulating material such as Mylar, provides structural support to the semiconductor ignitor 15 when loaded, thereby preventing any stress-induced change in substrate resistivity and the prevention of any ohmic contact between the button 29 and the semiconductor substrate. In addition, the insulating ring 27 helps prevent the flow of metals which have been deposited upon the semiconductor substrate. Compression of a semiconductor ignitor not provided with an insulating ring 27 is believed to produce localized changes in substrate resistivity and ohmic contacts which degrade the performance of the device. When a mask of electrically insulating material 27 is employed it is preferably in the form of a washer having overall dimensions approximately equal to that of the substrate 21 and a central opening which is slightly smaller than the contact pad 23 on the bottom face of the substrate 21. The washer is placed against the contact pad 23 concentrically to prevent stress-induced changes in substrate resistivity.

In a preferred embodiment, shown in FIG. 2, an additional insulating ring 25 is placed ahead of the semiconductor ignitor 15 and in contact with an annular portion of the topmost metal layer 17 and the bottom of the inner support cup 31. This arrangement reduces the possibility of "coining" and provides additional cushioning against mechanical shocks which can cause transient variations in substrate resistivity. In addition, the second ring 25 functions much like the bottom ring 27 by preventing ohmic contact between the inner support cup 31 and the edge of the silicon substrate 21. The second ring 25 (and bottom ring 27 when not an oxide) is preferably made of Mylar, or some other type of plastic which exhibits similar voltage breakdown characteristics, melting temperature, and elastic modulus.

Figure 3:
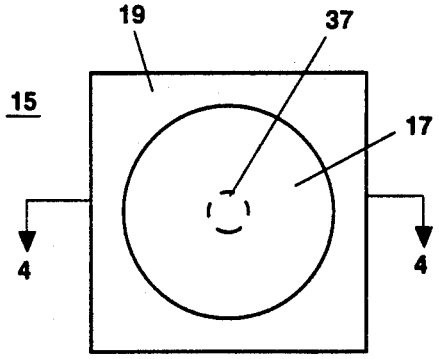
FIG. 3 is a top view of the semiconductor ignitor showing the contact metal and oxide layer.
Figure 4:
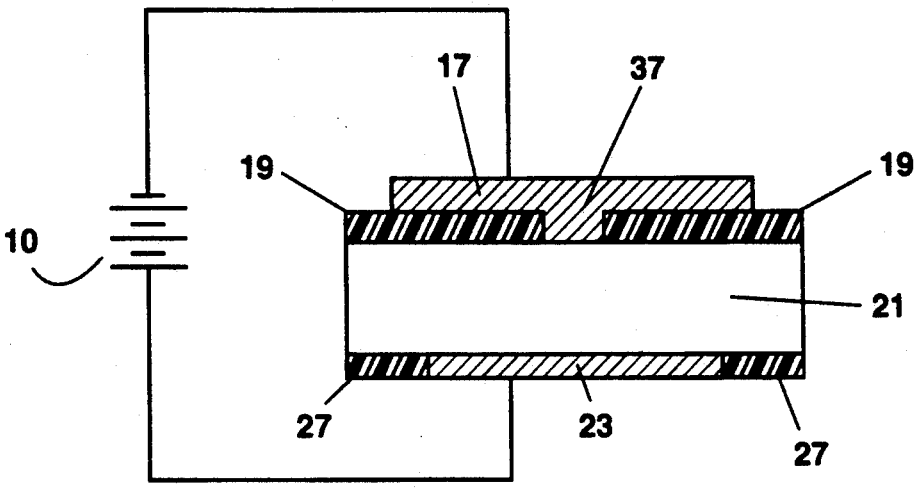
FIG. 4 is a cross-sectional view of the semiconductor ignitor taken along line 4—4 of FIG. 3.
Figure 5:
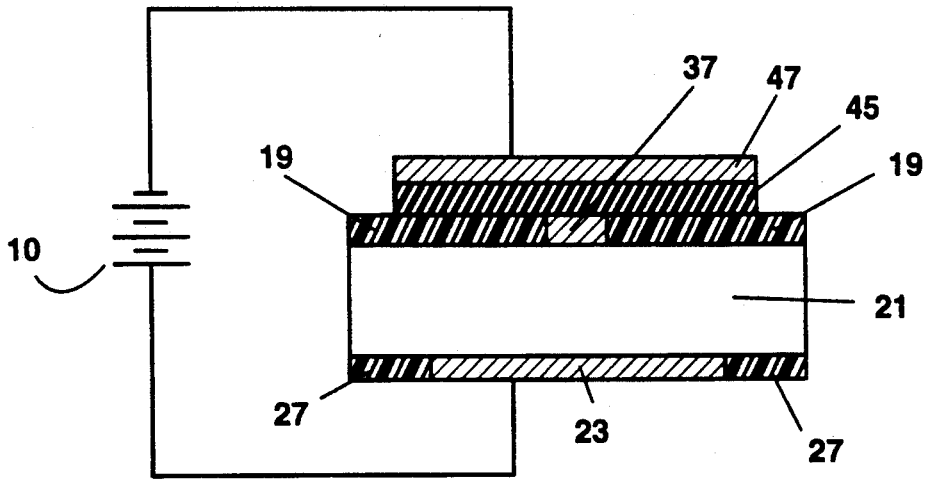
FIG. 5 is a cross-sectional view of the semiconductor ignitor taken along line 4—4 of FIG. 3 in which three distinct metal layers are employed on top.

FIGS. 3 and 4 show a top view and cross-section of a semiconductor ignitor 15 according to the present invention. The ignitor 15 is fabricated on a double polished n-type silicon substrate 21 having a <100> orientation and typically a 1.3 ohm-cm resistivity. It should be noted, however, that substrates exhibiting resistivities between 0.1 and 2.0 ohm-cm have also been tested successfully. Portions of the top and bottom surfaces of the substrate 21 are metallized 37, 23 to create two back-to-back Schottky barrier diodes. The top surface hosts a small metal plug 37 which is centrally located in a thick layer of oxide ($SiO_2$) 19. The oxide layer 19 and plug 37 are overlaid with metal to form an electrical contact 17. The bottom surface also comprises a metallized portion 23 which is larger than the metal plug 37 located on the top surface, and which doubles as an electrical contact. In addition, the bottom surface is provided with a ring of insulating material 27 which surrounds the metallized region 23 and extends at least as far as the edges of the substrate 21.

In a preferred embodiment, a 10,000. Å thick layer of $SiC_2$ is grown on both sides of a double polished silicon substrate 21 in pyrogenic steam at 1000° C. for approximately 300 minutes. The back, or bottom, side of the substrate 21 is coated with a thin layer of photoresist and softbaked in a convection oven at 100° C. for 30 minutes. A 120 mil-diameter hole is then exposed and developed upon this surface. At this point, the top side of the substrate 21 is also coated with photoresist, and the assembly hardbaked in a convection oven at 140° C. for 30 minutes. Bathing the assembly in a buffered oxide etch produces a 120 mil hole in the bottom oxide layer, leaving a portion of the silicon substrate 21 exposed. The remaining oxide on the bottom surface is etched down to a thickness of about 2500 Å. Later, a 2500 Å thick layer of platinum is sputtered into the 120 mil hole and annealed, forming a Schottky barrier diode on the back surface of the silicon substrate 21.

In order to form the metal plug 37 on the top surface of the substrate 21, the hardcoat on the top surface is stripped and another thin coat of photoresist applied upon the 10,000 Å thick oxide layer 19. A 5 micron square hole is exposed on the top surface of the assembly, and is subsequently etched down to the silicon substrate 21. A layer of aluminum approximately 5000 Å thick is then laid by planetary sputtering upon the oxide layer 19. As a consequence, the 5 micron square hole is filled forming a plug of aluminum 37 on the top surface of the substrate 21, and, after annealing, another Schottky barrier diode is formed. Of course, other sizes and shapes of hole may be created, and in some cases it may be useful to provide a plurality of holes. However, a group of ignitors with more than one Schottky junction on top were tested and found to cause diversion of the firing current between pads prior to the creation of a viable plasma jet at one location.

In a preferred embodiment, a 100Å thick, and 140 mil diameter contact pad of chromium 45 is deposited upon the aluminum plug 37 for purposes of adhesion. A final layer of gold 47, typically 500 Å thick and of the same diameter as the chromium 45, is deposited atop the chromium 45 for environmental stability and shelf-life. This combination of metals has exhibited superior adhesion and environmental resistance while ensuring reliable performance of the semiconductor ignitor.

In operation, a voltage potential 10 of approximately 400 volts is created across bottom and top surfaces of the semiconductor ignitor 15. The small size of the plug 37 relative to the bottom contact metal 23 ensures sufficient current density to vaporize the plug 37 and cause ignition of the primer mix 33. Tests have shown that the thickness of the top oxide layer 19 on the surface of the substrate 21 influences the point of ignition. It is felt that in order to fire reliably, an ignitor must channel its energy into the centermost region of the chip. Oxide layers 19 having thicknesses appreciably less than 10,000 Å exhibited point defect failures at numerous locations around the chip, causing a decrease in firing reliability.

While there has been described and illustrated specific embodiments of the invention, it will be obvious that various changes, modifications and additions can be made herein without departing from the field of the invention, which should be limited only by the scope of the appended claims.

We claim:

1. A semiconductor ignitor comprising a silicon substrate having substantially planar top and bottom faces, a layer of metal deposited over only a portion of said bottom face to form a Schottky barrier diode and contact pad thereon, another layer of metal deposited over a smaller portion of said top face to form a second Schottky barrier diode and a consumable plug thereon, wherein those portions of said top and bottom faces which have not been deposited upon are covered with an electrically insulating material, and another layer of metal is deposited upon both the consumable plug and the electrically insulating material on said top face to form a contact pad thereon.

2. The invention of claim 1 wherein said electrically insulating material is an oxide layer which is grown upon the exposed portions of said substrate.

3. The invention of claim 1 wherein said electrically insulating material, on the bottom face, is a washer the metallized portion of said bottom face, said washer being placed in contact with said contact pad on the bottom of said substrate in a concentric manner, thereby preventing stress-induced changes in substrate resistivity and undesirable ohmic contacts.

4. The invention of claim 3 wherein a second, substantially identical washer is placed in contact with the contact pad on the top face of said substrate in a concentric manner to further improve reliability.

5. The invention of claim I, 2, 3, or 4 wherein said contact pad on the top face of said substrate is bi-metallic, being comprised of an adhesive layer of metal in contact with said consumable plug, and a substantially inert layer of metal atop said adhesive layer.

6. The invention of claim 5 wherein said contact pad on the bottom face of said substrate is comprised of annealed platinum, said plug on the top face of said substrate is comprised of annealed aluminum, said adhesive layer is comprised of chromium, and said substantially inert layer is comprised of gold.

7. A semiconductor ignitor assembly comprising a silicon substrate having substantially planar top and bottom faces, a layer of metal deposited over only a portion of said bottom face to form a Schottky barrier diode and contact pad thereon, another layer of metal deposited over a smaller portion of said top face to form a second Schottky barrier diode and consumable plug thereon, wherein those portions of said top and faces which have not been deposited upon are covered with silicon dioxide, said silicon dioxide on the bottom face having a thickness of approximately 2500 Å and another layer of metal if deposited upon both the consumable plug and the silicon dioxide on said top face to form a contact pad thereon, and wherein means are provided for applying approximately 400 volts across said ignitor to induce firing thereof.

8. A semiconductor ignitor assembly comprising a silicon substrate having substantially planar top and bottom faces, a layer of platinum deposited over only a portion of said bottom face to form a Schottky barrier diode and contact pad thereon, a layer of aluminum deposited over a smaller portion of said top face to form a second Schottky barrier diode and consumable plug thereon, a ring of silicon dioxide having a thickness of approximately 2500 Å covering that portion of the bottom face which has not been deposited upon, a ring of silicon dioxide having a thickness of approximately 10,000 Å covering that portion of said top face which has not been deposited upon, a bi-metallic layer of chromium and gold which is deposited upon both the consumable plug and the silicon dioxide such that the chromium is disposed between the aluminum and gold to ensure adhesion, and wherein means are provided for applying approximately 400 volts across said platinum contact pad and bi-metallic layer to induce firing of said ignitor.

9. A primer cup assembly for a round of electrically-fired ammunition, said primer cup assembly comprising:

a tubular housing which is electrically conductive and open at both ends, said housing further provided at one end with a lip;

an electrically conductive inner support cup which is press-fitted into said conductive housing;

an electrically conductive primer mix disposed within said electrically conductive inner support cup;

an electrically conductive button disposed between said housing and inner support cup;

means to electrically isolate said button from said housing;

a semiconductor ignitor comprising:

a silicon substrate having top and bottom faces;

a metal barrier upon only a portion of the bottom face of said substrate;

a metal plug upon a smaller portion of the front face of said substrate;

a bi-metallic layer atop said metal plug comprising an adhesive metal in contact with said plug, and a substantially inert metal atop said adhesive metal;

rings of electrically insulating material disposed between said substrate and electrically conductive button, and between said substrate and inner support cup;

electrically conductive epoxy disposed between said conductive button and said metal barrier on the back face of said substrate, and between said inert layer of metal and said inner support cup.

10. The invention of claim 9 wherein said metal barrier is platinum, said metal plug is aluminum, said adhesive metal is chromium, and said substantially inert metal is gold.

11. The invention of claim 9 or 10 wherein said electrically insulating material disposed between said substrate and said electrically conductive button is an oxide ring and said electrically insulating material disposed between said substrate and said inner support cup is comprised of an oxide ring and plastic washer, wherein said oxide ring is disposed between said substrate and said washer.

12. The invention of claim 11 wherein said oxide ring disposed between said substrate and said washer has a thickness of approximately 10,000 Å to promote center firing of said ignitor.

* * * * *